United States Patent [19]

Datta

[11] Patent Number: 4,482,397

[45] Date of Patent: Nov. 13, 1984

[54] METHOD FOR IMPROVING THE MAGNETIC PERMEABILITY OF GRAIN ORIENTED SILICON STEEL

[75] Inventor: Amitava Datta, Morris Township, Morris County, N.J.

[73] Assignee: Allegheny Ludlum Steel Corporation, Pittsburgh, Pa.

[21] Appl. No.: 475,425

[22] Filed: Mar. 15, 1983

Related U.S. Application Data

[63] Continuation-in-part of Ser. No. 295,592, Aug. 24, 1981, abandoned.

[51] Int. Cl.[3] ..... H01F 1/04

[52] U.S. Cl. ..... 148/111; 148/112

[58] Field of Search ..... 148/110, 111, 112, 113

[56] References Cited

U.S. PATENT DOCUMENTS

| | | | |
|---|---|---|---|
| 1,887,339 | 11/1932 | Stroble | 148/111 |
| 2,412,041 | 12/1946 | Gifford et al. | 148/110 |
| 3,905,842 | 9/1975 | Grenoble | 148/112 |
| 4,000,015 | 12/1976 | Malagari et al. | 148/111 |
| 4,054,471 | 10/1977 | Datta | 148/112 |
| 4,290,829 | 9/1981 | Koshiishi et al. | 148/112 |
| 4,371,405 | 2/1983 | Harase et al. | 148/111 |

*Primary Examiner*—John P. Sheehan

*Attorney, Agent, or Firm*—Patrick J. Viccaro

[57] ABSTRACT

An improvement in the manufacture of oriented silicon steel; the improvement comprises normalizing the steel to effect decarburization and primary recrystallization and tensile straining said steel prior to final texture annealing. The steel may be subjected to tensile straining either during or after normalizing.

5 Claims, 2 Drawing Figures

1900
1800
1700
μ at 10H
As Recieved
(pack value = 1932)
Δμ ≈ 100
10H
1000
1100
1200
1300
1400
1500
1600
1700
1800
1900
2000
2100
Temperature ( F) at which tension was applied
Strained at .0017 inches/inch/minute for 50 mins.
Held at respective temperature for 50 mins.

METHOD FOR IMPROVING THE MAGNETIC PERMEABILITY OF GRAIN ORIENTED SILICON STEEL

This is a Continuation-in-Part Application of Application Ser. No. 295,592, filed Aug. 24, 1981, now abandoned.

Oriented silicon steel, in the form of sheets, is known for use in various electrical applications, including the manufacture of transformer cores. Oriented silicon steel is characterized by a secondary recrystallization in the (110) [001] texture which is termed cube-on-edge. This material in sheet form has a direction of easy magnetization in the direction of rolling. For its intended purpose it is desirable that the material be characterized by high magnetic permeability.

It is accordingly an object of the present invention to provide a method whereby oriented silicon steel may be provided with improved magnetic permeability.

Figure 1:
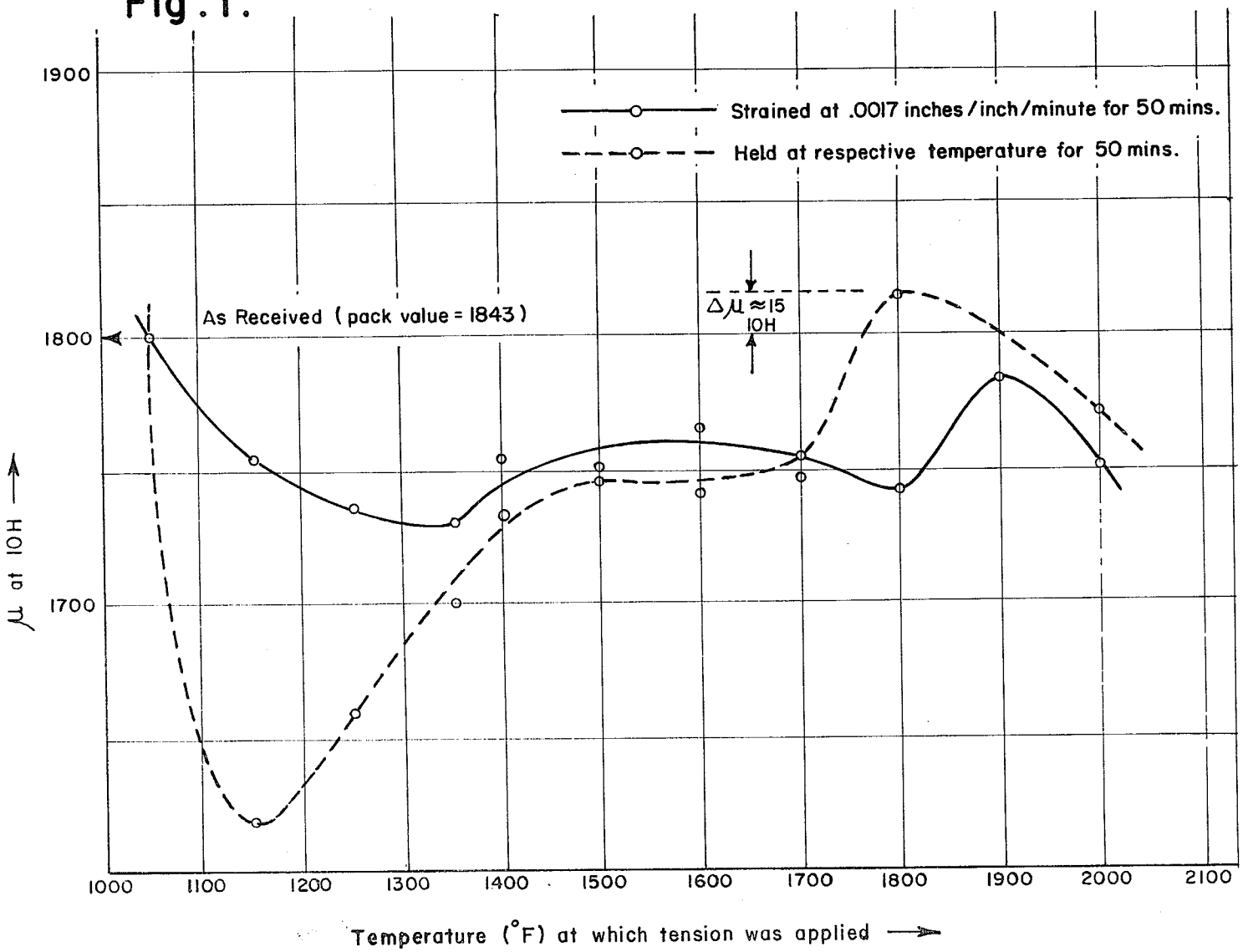
Figure 2:
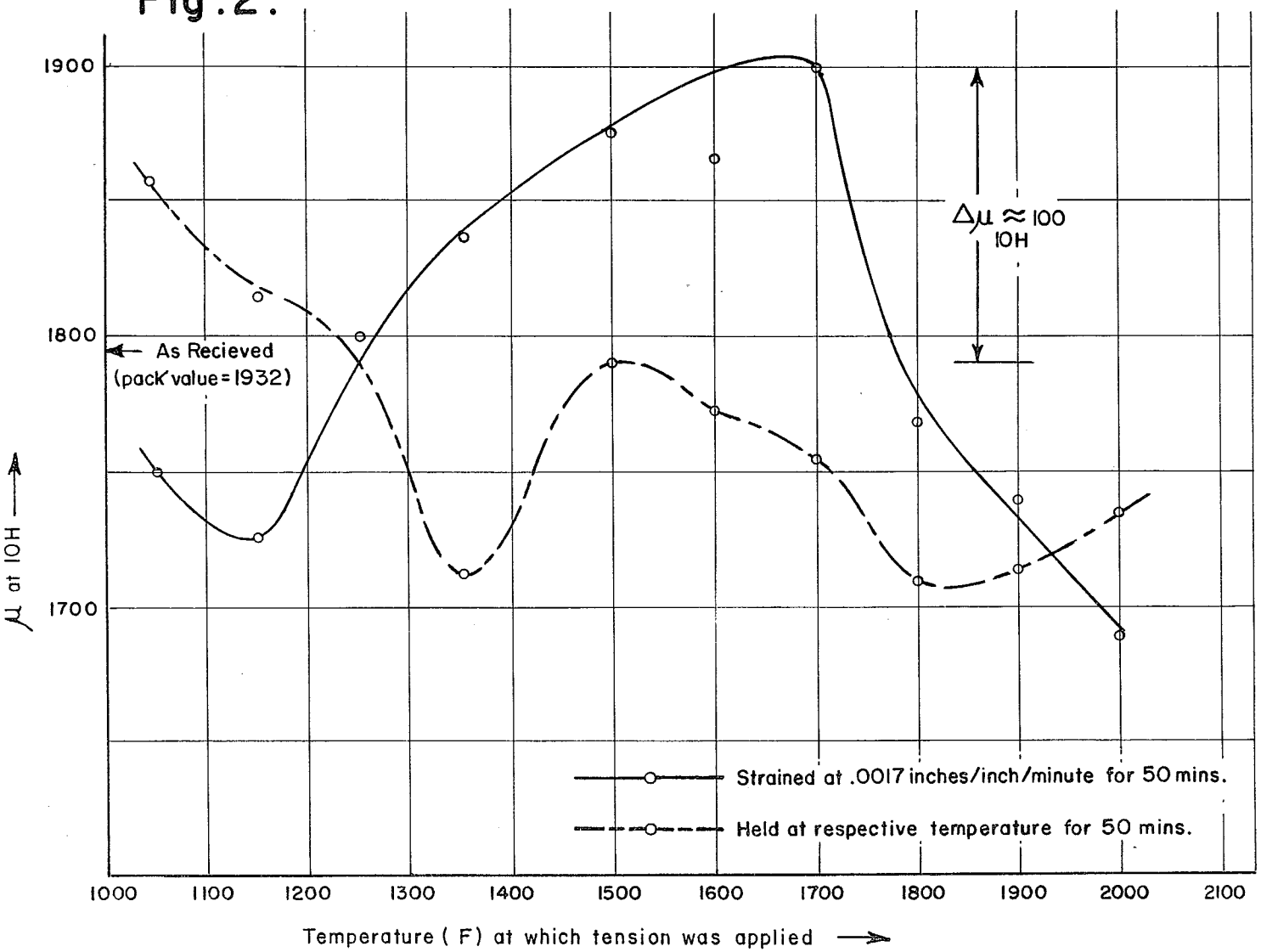

This and other objects of the invention, as well as a more complete understanding thereof, may be obtained from the following description and specific examples including the drawings, in which:

FIG. 1 is a graph showing the magnetic permeability for a specific composition of oriented silicon steel when processed in accordance with the invention as compared to conventional processing; and FIG. 2 is a graph similar to FIG. 1 but for an alternate oriented silicon steel composition.

Broadly, in accordance with the practice of the invention it has been determined that if oriented silicon steel, such as in the form of sheet material, is subjected to tensile strain either during or after normalizing and prior to final texture annealing, improved magnetic permeability will result. In particular, most improved magnetic permeability occurs when the steel has undergone a large final cold reduction of greater than about 70%, preferably greater than about 80%, prior to normalizing than occurs when the steel is given a conventional two-stage reduction using a conventional final cold reduction of less than about 70%. In typical processing, oriented silicon steel after hot rolling is subjected to a plurality of cold rolling operations with or without intermediate anneals and a final high temperature normalizing treatment during which decarburization and primary recrystallization is achieved. Thereafter, the material is conventionally coated and final texture annealed to achieve secondary recrystallization. Although the mechanism of the invention for improving magnetic permeability in oriented silicon steel is not completely understood, it is believed that it results from promoting growth of subgrains to result in a more potent and effective nuclei for the final secondary recrystallization. The mechanism is evidently most effective when the final or penultimate cold reduction is large, i.e., greater than about 70%.

To demonstrate the invention by way of specific example, samples of the following compositions designated as SX-10 and SX-13 were provided within the following composition limits, by weight percent:

| | C | Mn | S | Si | Al |
|---|---|---|---|---|---|
| SX-10 | .030 | .053 | .021 | 3.17 | .005 |
| SX-13 | .063 | .097 | .043 | 2.90 | .028 |

The SX-10 samples were processed through final cold reduction using a conventional two-state cold reduction sequence employing a final cold reduction of about 61%. The SX-13 samples were processed using a final cold reduction of about 86%. The SX-13 samples contained between 0.01 to 0.05% aluminum.

Cold rolled samples of the above SX-10 and SX-13 compositions were subjected to a normalizing treatment. During normalizing the treatment was interrupted for various samples which were pulled in tension at a temperature of 1050°, 1150°, 1250° and 1350° F. in an argon atmosphere at 0.0017 inches/inch/minute for 50 minutes to provide a total strain of 0.085 inches/inch. Samples were also removed from the normalizing treatment at these same temperatures and were likewise held in argon for 50 minutes but were not pulled in tension. In addition, samples after normalizing were pulled in tension at 1500°, 1600°, 1700°, 1800°, 1900° and 2000° F. in argon at 0.0017 inches/inch/minute for 50 minutes to provide a total strain of 0.085 inches/inch. Likewise, samples of the same material were held at these temperatures in argon for 50 minutes but were not subjected to tension. After the above treatments in argon, the resulting oxide scale was removed by surface grinding and single Epstein strips were prepared for normalizing, coating and final texture annealing. After texture annealing, measurements were made to determine the magnetic permeability of the samples. The results of the magnetic permeability tests are set forth in FIG. 1 for the SX-10 samples and FIG. 2 for the SX-13 samples. As may be seen from FIGS. 1 and 2, for both of the compositions tested subjecting the test specimens to tensile strain during or after normalizing resulted in improved magnetic permeability over a wide range of normalizing temperatures as compared to the specimens which were subjected to identical normalizing temperatures in the absence of tensile strain. As may be seen from FIG. 1, subjecting the test specimens with a final reduction of about 61% to tensile strain during or after normalizing was only slightly effective in improving magnetic permeability, whereas FIG. 2 shows that subjecting the test specimens with a final reduction of about 86% was significantly effective. Although the effective temperatures at which strain during normalizing treatment is beneficial from the standpoint of improving magnetic permeability may differ with respect to different compositions and final reductions, it is to be understood that the effective and optimum temperature conditions for any oriented silicon steel composition which is processed in accordance with the invention may be determined by routine experimentation similar to the experiments shown herein.

Though the term "tensile strain" has been used herein, it should be understood that the present invention should not be so limited. Various strains, such as tensile, compressive and shear, and combinations thereof, should also be within the scope of the invention.

What is claimed is:

1. In a method for producing cube-on-edge oriented silicon steel, characterized by improved magnetic permeability, including the steps of hot rolling, cold rolling with or without intermediate annealing and a final texture annealing, the improvement comprising cold rolling the steel with a final reduction of greater than about 70%, normalizing said steel to effect decarburization and primary recrystallization and tensile straining said steel after cold rolling and prior to final texture annealing to promote secondary recrystallization during said final texture annealing.

2. The method of claim 1 wherein said steel is subjected to said tensile straining during normalizing.

3. The method of claim 1 wherein said steel is subjected to said tensile straining after normalizing.

4. The method of claim 1 wherein the final reduction is greater than about 80%.

5. The method of claim 1 wherein said steel contains from 0.01 to 0.05% aluminum.

* * * * *